United States Patent [19]

Hudson

[11] 3,998,184

[45] Dec. 21, 1976

[54] DEVELOPMENT APPARATUS

[75] Inventor: David H. Hudson, Holcomb, N.Y.

[73] Assignee: Xerox Corporation, Stamford, Conn.

[22] Filed: Mar. 20, 1975

[21] Appl. No.: 560,073

[52] U.S. Cl. ..... 118/658

[51] Int. Cl.[2] ..... G03G 15/09

[58] Field of Search ..... 118/637; 427/18, 20; 355/3 DD

[56] References Cited

UNITED STATES PATENTS

| | | | |
|---|---|---|---|
| 3,303,817 | 2/1967 | Cranch et al. | 118/637 |
| 3,347,691 | 10/1967 | Lyles | 118/637 |
| 3,536,042 | 10/1970 | Weiler | 118/637 |
| 3,608,522 | 9/1971 | Davidson | 118/637 |
| 3,641,981 | 2/1972 | Hudson | 118/637 |
| 3,783,828 | 1/1974 | Forgo et al. | 118/637 |
| 3,788,275 | 1/1974 | Hanson | 118/637 |
| 3,854,449 | 12/1974 | Davidson | 118/637 |
| 3,893,413 | 7/1975 | Weiler | 118/637 |

*Primary Examiner*—Mervin Stein
*Assistant Examiner*—Douglas Salser
*Attorney, Agent, or Firm*—H. Fleischer; J. J. Ralabate; C. A. Green

[57] ABSTRACT

A developer unit in which buckets in a cylindrical member advance particles from a first region to a second region. The particles are moved from the second region to a latent image rendering it visible.

The foregoing abstract is neither intended to define the invention disclosed in the specification, nor is it intended to be limiting as to the scope of the invention in any way.

10 Claims, 4 Drawing Figures

DEVELOPMENT APPARATUS

BACKGROUND OF THE INVENTION

This invention relates generally to an electrostatographic printing machine, and more particularly concerns an improved development system for use therein.

In the process of electrostatographic printing, an electrostatic latent charge pattern is recorded and reproduced in viewable form. The field of electrostatography includes electrophotography and electrography. Electrophotography is a class of electrostatography which employs a photosensitive medium to form, with the aid of electromagnetic radiation, the electrostatic latent charge pattern. Electrography is that class of electrostatography which utilizes an insulating medium to form, without the aid of electromagnetic radiation, the electrostatic latent charge pattern. Development, which is the act of rendering an electrostatic latent pattern or image viewable, is employed in all of the aforementioned classes of electrostatography. Hereinafter, an electrophotographic printing machine will be described as an illustrative example of this process.

An electrophotographic printing machine utilizes a photosensitive element having a photoconductive insulating layer charged to a substantially uniform potential so as to sensitize its surface. The charged photoconductive surface is exposed to a light image of an original document being reproduced. As a consequence of this exposure, the charge is selectively dissipated in the irradiated areas in accordance with the light intensity reaching the surface. In this manner, an electrostatic latent image is recorded on the photoconductive surface corresponding to the original document. Development of the electrostatic latent image recorded on the photoconductive surface is achieved by bringing the latent image into contact with a developer mix. Typical developer mixes are well known in the art and generally include dyed or colored heat settable thermoplastic particles known as toner particles which are mixed with coarser carrier granules, such as ferromagnetic granules. The toner particles and carrier granules are selected such that the toner particles acquire the appropriate charge relative to the electrostatic latent image recorded on the photoconductive member. When the developer mix is brought into contact with the charged photoconductive surface, the greater attractive force of the electrostatic latent image recorded thereon causes the toner particles to move from the carrier granules to the electrostatic latent image. This concept was originally disclosed in U.S. Pat. No. 2,297,691 issued to Carlson in 1942, and is further amplified and described by many related patents in the art.

Many factors influence the quality of the developed image, the most significant factor being the uniformity with which the toner particles are deposited on the electrostatic latent image recorded on the photoconductive member. Heretofore, development systems have employed rotary impellors, bucket conveyors, and magnetic brush systems to achieve the requisite uniformity in toner deposition. The magnetic brush system achieves a high degree of uniform toner deposition, and, therefore, is utilized in numerous electrostatographic printing machines. Generally, a magnetic brush development system includes a developer roll having a directional flux field for bringing the magnetizable developer mix into contact with the electrostatic latent image recorded on the photoconductive member.

Multi-color electrostatographic printing produces a series of electrostatic latent images corresponding to a single color of the original document. Successive partial color light images are employed to record each of the single color latent images. Each single color electrostatic latent image is developed with toner particles of a color complimentary to the color of the light image to form a subtractive system.

Generally, a multi-color development system utilizes a plurality of developer rolls, each being adapted to furnish the appropriate color toner particles to the photoconductive member. This requires that only one development unit be closely adjacent to the electrostatic latent image with the remaining units being spaced therefrom. Thus, successive electrostatic latent images are developed with different color toner particles.

The developer mix is advanced from a sump in the developer housing to the developer roll by a paddle wheel. Heretofore, the paddle wheel including a plurality of buckets secured to the periphery of a cylindrical member. The side walls of the buckets were of an equal height. Rotation of the cylindrical member caused the buckets to fill with the developer mix and advance in an upwardly direction to the developer roll. The foregoing type of system is described in U.S. Pat. No. 3,854,449 issued to Davidson in 1974. However, in systems of this type, the toner particles frequently bridge across the top of the buckets resulting in an uneven amount of material being advanced by each bucket. This introduces significant problems in eveness of toner deposition and may degradate the performance of the system. Moreover, in a system of this type, wherein additional toner particles are furnished to the developer mix to maintain the concentration thereof substantially constant, erroneous readings may be noted. It is apparent that if insufficient developer mix and toner particles are advanced to the photoconductive member, the monitoring system will indicate that the toner particles concentration level is low. Accordingly, excessive toner particles may be furnished to the developer mix increasing the concentration above the acceptable level.

Accordingly, it is a primary object of the present invention to improve the development of an electrophotographic printing machine by advancing the requisite quantity of developer mix to the electrostatic latent image recorded on the photoconductive member.

BRIEF SUMMARY OF THE INVENTION

Briefly stated, and in accordance with the present invention, there is provided an apparatus for rendering a latent image visible.

Pursuant to the features of the present invention, the apparatus comprises a housing member defining a chamber for storing a supply of particles therein. Means are provided for depositing particles on the latent image. A cylindrical member is mounted movably in the housing member to advance the particles from the chamber to the depositing means. The cylindrical member has a plurality of spaced buckets secured to the peripheral surface thereof. Each bucket extends lengthwise in a direction substantially parallel to the longitudinal axis of the cylindrical member. All of the buckets have a pair of spaced walls extending radially outwardly from the peripheral surface of the cylindrical member. One of the pair of spaced walls extends a greater radially distance than the other one of the pair of walls.

BRIEF DESCRIPTION OF THE DRAWINGS

Other objects and advantages of the present invention will become apparent upon reading the following detailed description and upon reference to the drawings in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
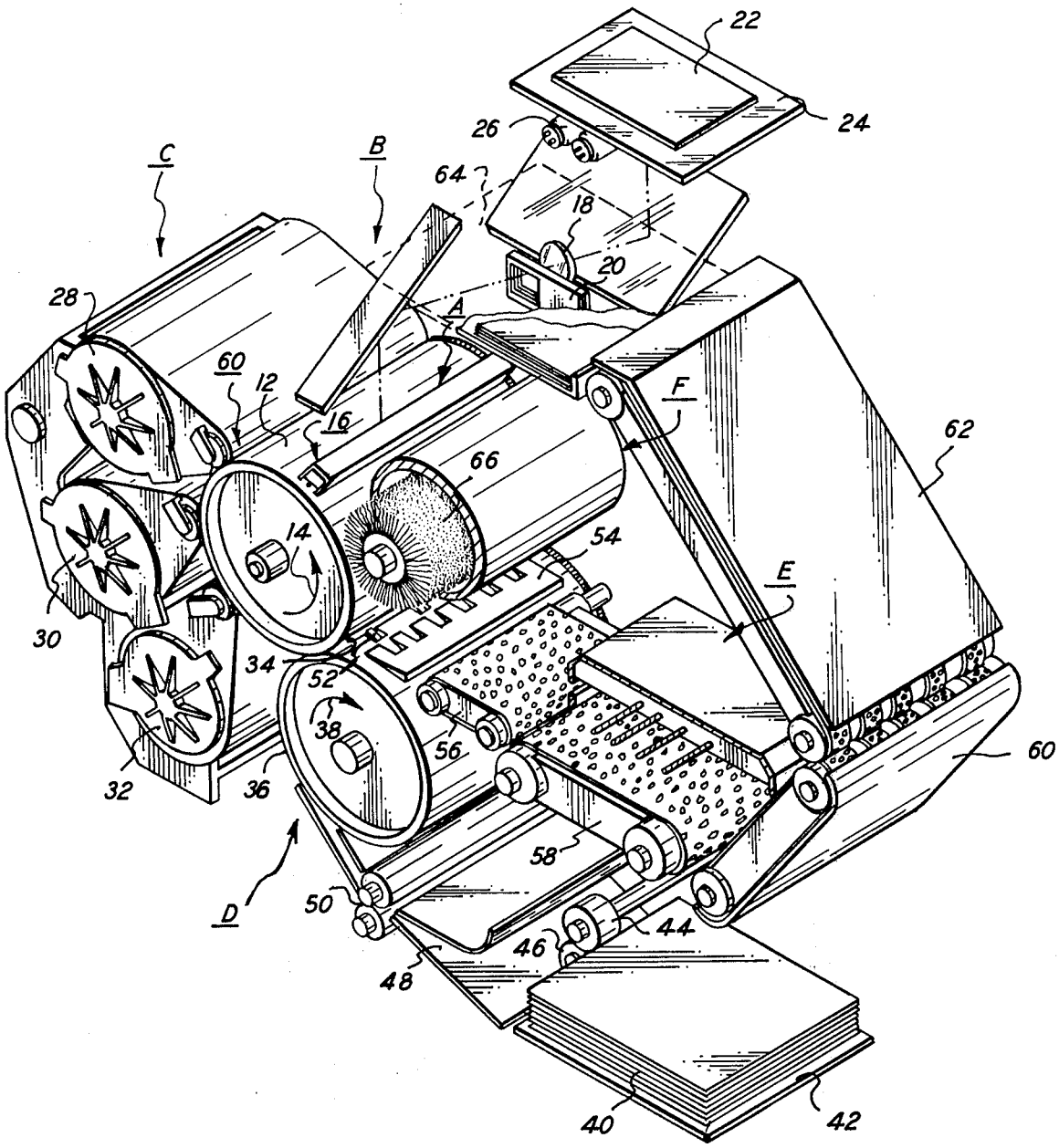
FIG. 1 is a schematic perspective view of an electrophotographic printing machine embodying the features of the present invention therein.

For a general understanding of the illustrated electrophotographic printing machine, in which the present invention may be incorporated, reference is had to the drawings. In the drawings like reference numerals have been used throughout to designate like elements. FIG. 1 schematically depicts the various components of a printing machine arranged to reproduce colored copies from a colored original document. As in all electrophotographic printing machines of the type illustrated, a light image of an original document being reproduced is projected onto a sensitized photoconductive surface forming an electrostatic latent image thereon. This latent image is developed with toner particles to form a powder image thereof. The powder image is subsequently transferred to a sheet of support material where it is permanently affixed forming a copy of the original document. Although the development system of the present invention is particularly, well adapted for use in a color electrophotographic printing machine, it should become evident from the following discussion that it is equally well suited for use in a wide variety of electrostatographic printing machines and is not necessarily limited to the particular embodiment described herein.

As depicted in FIG. 1, the electrophotographic printing machine employs a photoconductive member having a drum 10 mounted rotatably within the printing machine frame (not shown). Photoconductive surface 12 is mounted on the exterior circumferential surface of drum 10 being entrained thereabout. A polychromatic selenium alloy, such as is described in U.S. Pat. No. 3,655,377 issued to Sechak in 1972, is a suitable photoconductive material.

A series of processing stations are located about the periphery of drum 10. In this manner, as drum 10 rotates in the direction of arrow 14, it passes sequentially through each of the processing stations. Drum 10 is driven at a predetermined speed relative to the other machine operating mechanisms from a common drive motor (not shown). A timing disc, mounted in the region of one end of the shaft of drum 10, cooperates with the machine logic to synchronize the operations of the respective processing stations with the rotation of drum 10.

For purposes of the present invention, the various processing stations in the printing machine will be briefly described hereinafter.

First, drum 10 rotates photoconductive surface 12 through charging station A. At charging station A, a corona generating device, indicated generally by the reference numeral 16, extends in a longitudinal direction transversely across photoconductive surface 12. Corona generating device 16 sprays ions onto photoconductive surface 12 producing a relatively high, substantially uniform charge thereon. Copending application Ser. No. 307,250 filed in 1972 describes corona generator 16 in greater detail, the disclosure thereof being hereby incorporated into the present application.

After photoconductive surface 12 is charged to a substantially uniform potential, drum 10 is rotated to exposure station B. At exposure station B, a color filtered light image of the original document is projected onto the charged portion of photoconductive surface 12. Exposure station B includes a moving lens system, generally designated by the reference numeral 18, and a color filter mechanism, shown generally at 20. An original document 22 is stationarily supported upon transparent viewing platen 24 in a facedown position. In this manner, successive incremental areas of original document 22 are illuminated by moving lamp assembly 26. Lens 18, filter 20, and lamps 26 move in synchronism across original document 22 to project a flowing light image onto the charged portion of photoconductive surface 12 as drum 10 rotates in the direction of arrow 14. Filter 20 operates on the light image passing through lens 18 to form a single color light image which records an electrostatic latent image on photoconductive surface 12 corresponding thereto. A suitable drive system for the optical system is described in U.S. Pat. No. 3,062,109 issued to Mayo, et al. in 1962. Lens 18 is preferably a six element split dagor type of lens which is described in U.S. Pat. No. 3,592,531 issued to McCrobie in 1971. Similarly, filter mechanism 20 is described in U.S. Pat. No. 3,775,006 issued to Hartman, et al. in 1973.

After the electrostatic latent image is recorded on photoconductive surface 12, drum 10 rotates the latent image to development station C. At development station C, three individual developer units, generally indicated by the reference numerals 28, 30 and 32, respectively, render the electrostatic latent image visible. The development units are all of a type generally referred to in the art as a magnetic brush development units. In a magnetic brush development unit, a magnetizable developer mix of carrier granules and toner particles is continually brought through a directional flux field to form a brush of developer mix. The developer mix is continually moving to provide fresh material to the brush. Preferably, the development unit comprises a magnetic member with a mass of developer mix adhering thereto by magnetic attraction. The developer mix includes carrier granules having toner particles clinging thereto by triboelectric attraction. This chain-like arrangement of developer mix simulates the fibers of a brush. Development is achieved by bringing the brush of developer mix into contact with photoconductive surface 12. Each of development units 28, 30 and 32, respectively, apply toner particles to photoconductive surface 12. The respective toner particles in each of the development units are adapted to absorb light within a pre-selected spectral region of the electromagnetic wave spectrum corresponding to the wave length of light transmitted through the filter. For example, a latent image formed by passing the light image through a green filter will record the red and blue portions of the spectrum as areas of relatively high charge density on photoconductive surface 12. All the green light rays will pass through the filter and cause the charge density on photoconductive surface 12 to be reduced to a voltage level ineffective for development. The charged areas are made visible by applying green absorbing (magenta) toner particles to the latent image recorded on photoconductive surface 12. Similarly, a blue separation is developed with blue absorbing (yellow) toner particles, while a red separation is developed with red absorbing (cyan) toner particles. The development system will be discussed hereinafter in greater detail with reference to FIGS. 2 through 4, inclusive. It is also described in U.S. Pat. No. 3,854,449 issued to Davidson in 1974, the relevant portions of that disclosure being hereby incorporated into the present application.

After development, the now visible powder image is moved to transfer station D. At transfer station D, the powder image is transferred to a sheet of support material 34. Support material 34 may be plain paper or a sheet of thermoplastic material, amongst others. Transfer station D includes a transfer roll 36 adapted to recirculate support material 34. Transfer roll 36 is electrically biased to a potential of sufficient magnitude and polarity to attract electrostatically the toner particles from the latent image recorded on photoconductive surface 12 to support material 34. Transfer roll 36 rotates in synchronism with drum 10, in the direction of arrow 38, to maintain the electrostatic latent image recorded on photoconductive surface 12 in registration with support material 34 secured releasably thereto. Inasmuch as transfer roll 36 rotates in the direction of arrow 38, at substantially the same tangential velocity as drum 10, successive toner powder images may be transferred to support material 34 in superimposed registration with one another.

Prior to proceeding with the remaining processing stations in the printing machine, the sheet feeding path will be briefly described. Support material 34 is advanced from a stack 40 mounted on a tray 42. Feed roll 44, in operative communication with retard roll 46, advances and separates the uppermost sheet from stack 40. The advancing sheet moves into chute 48 which directs it into the nip between register rolls 50. Thereafter, gripper fingers 52, mounted on transfer roll 36, secure support material 34 releaseably thereto for recirculating movement therewith. After the requisite number of powder images have been transferred to support material 34, gripper fingers 52 release support material 34 and space it from transfer roll 36. As transfer roll 36 continues to rotate, stripper bar 54 is interposed between support material 34 and transfer roll 36 to separate support material 34 therefrom. Thereafter, endless belt conveyor 56 advances support material 34 to fixing station E.

At fixing station E, a fuser, indicated generally by the reference numeral 58, generates sufficient heat to permanently affix the transferred powder to support material 34. A suitable fuser is described in U.S. Pat. No. 3,781,516 issued to Tsilibes, et al. in 1973, the disclosure of which is hereby incorporated into the present application. After the fusing process, support material 34 is advanced by endless belt conveyors 60 and 62 to catch tray 64. At catch tray 64 the machine operator may remove the finished copy from the printing machine.

The remaining processing station, in the direction of rotation of drum 10, as indicated by arrow 14, is cleaning station F. Although a preponderance of toner particles are transferred to support material 34, invariably some residual toner particles remain on photoconductive surface 12 after the transfer of the toner powder images therefrom. These residual particles are removed from photoconductive surface 12 as it passes through cleaning station F. At cleaning station F, the residual toner particles are initially brought under the influence of a cleaning corona generating device (not shown) adapted to neutralize the electrostatic charge remaining on the residual toner particles and photoconductive surface 12. The neutralized toner particles are then cleaned from photoconductive surface 12 by a rotatably mounted fibrous brush 66 in contact therewith. A suitable brush cleaning device is described in U.S. Pat. No. 3,590,412 issued to Gerbasi in 1971.

It is believed that the foregoing description is sufficient for purposes of the present application to depict the general operation of an electrophotographic printing machine incorporating the features of the present invention therein.

Figure 2:
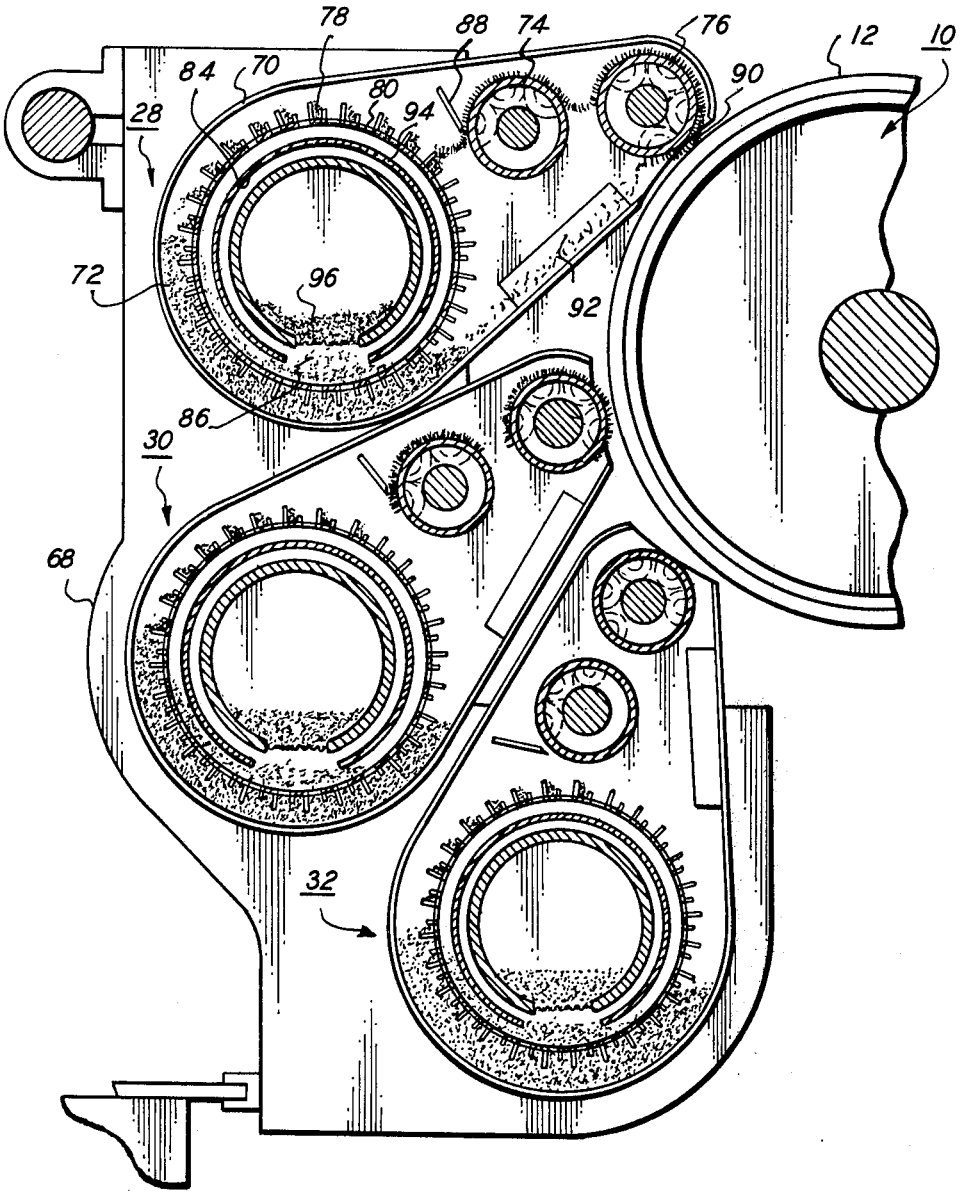
FIG. 2 is a sectional, elevational view of the development system of the present invention used in the printing machine illustrated in FIG. 1.
Figure 3:
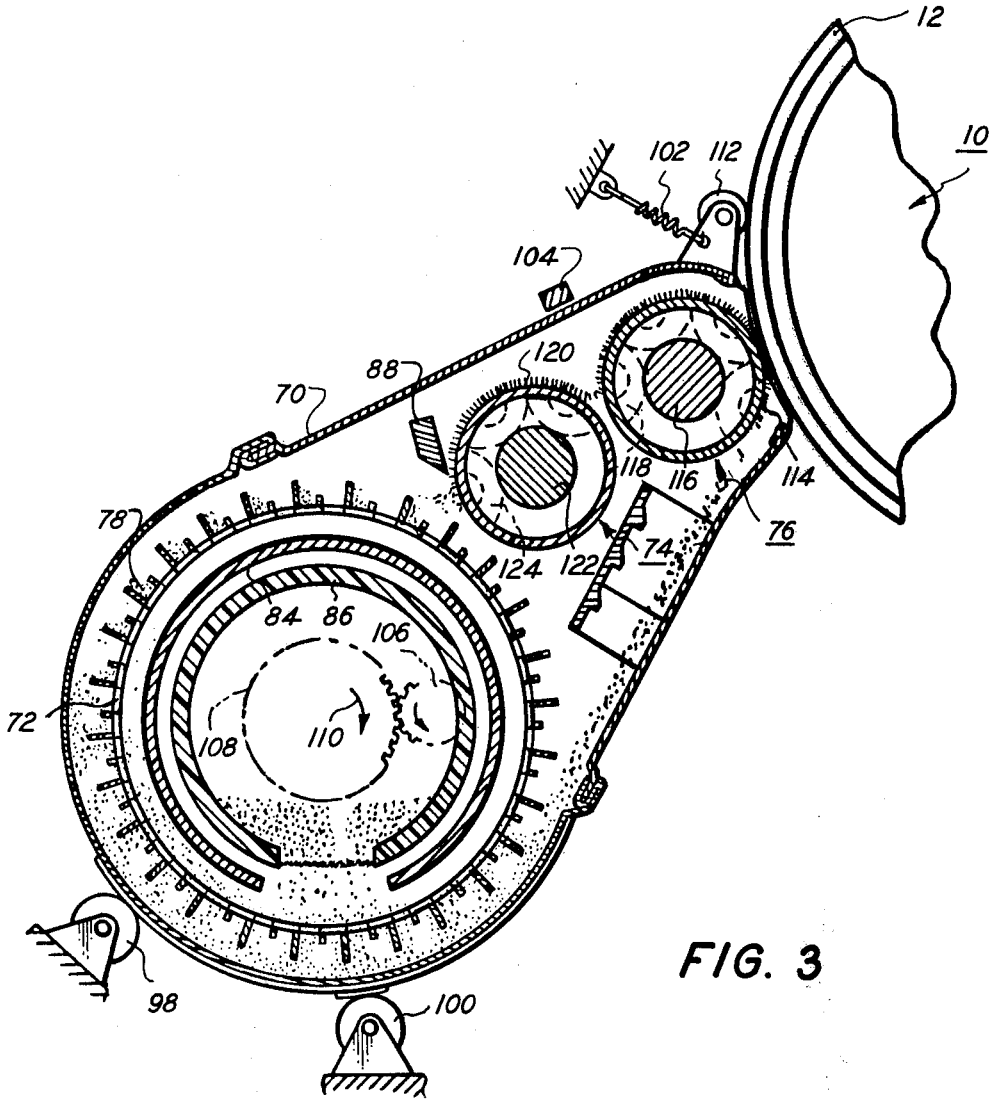
FIG. 3 is a fragmentary, sectional, elevational view depicting, in detail, one of the development units shown in FIG. 1.

Referring now to FIG. 2, there is shown a multi-color development system with frame 68 supporting three toner depositing means or development units 28, 30 and 32, respectively. The aforementioned development system is of the type utilized at development station C. These development units are depicted in an elevational sectional view to indicate more clearly the various components included therein. Only development unit 28 will be described in detail, as development units 30 and 32 are nearly identical thereto. The distinction between each of the development units resides in the color of the toner particles contained therein and minor geometrical differences due to the mounting position. Development unit 28 may have yellow toner particles, unit 39 magenta toner particles, and unit 32 cyan toner particles. However, it should be noted that any color combinations may be employed and there is no particular necessity to employ the foregoing color combination. For purposes of explanation, only development unit 28 will hereinafter be described in detail.

The principal components of development unit 28 are a developer housing 70, a cylindrical member 72, transport means 74, and developer means 76. cylindrical member 72 has a peripheral surface with spaced buckets 78 secured thereon. Interposed between each bucket are longitudinally extending slots 80. Cylindrical member 78 rotates to elevate developer mix 82 from the lower region of housing 70 to the upper region thereof. When developer mix 82 reaches the upper region of housing 70, it is lifted from buckets 78 to transport means 74. The developer mix not carried to transport means 74 falls back to the lower region of housing 70 by passing through slots 80 in cylindrical member 72. As the developer mix falls back to the lower region of housing 70, it cascades over shroud 84 which is of tubular configuration with an aperture 86 in the lower region thereof. Developer mix 82 is recirculated in this manner so that the carrier granules are continually agitated to mix with fresh toner particles.

This generates a strong triboelectric charge between the carrier granules and toner particles. As developer mix 82, in buckets 78, approaches transport means 74, the magnetic field produced by the field magnets therein attract developer mix 82 thereto. Transport means 74 moves developer mix 82 in an upwardly direction by the frictional force exerted between the surface thereof and the developer mix. A surplus of developer mix is furnished. Metering blade 88 is provided to control the amount of developer mix carried over the top of transport means 74. Surplus developer mix is sheared from transport means 74 and falls in a downwardly direction toward cylindrical member 72. As the surplus developer mix descends, it falls through slots 80 in a downwardly direction into the lower region of housing 70.

The developer mix, which passes metering blade 88, is carried by transport means 74 to developer means 76 and into development zone 90 located between photoconductive surface 12 and development means 76. The electrostatic latent image recorded on photoconductive surface 12 is developed by contacting the moving developer mix. Toner particles are attracted from the carrier granules of developer mix 82 and the latent image recorded on photoconductive surface 12. At the exit of development zone 90, the strong magnetic field in a direction generally tangential to developer means 76 continues to secure thereto the unused developer mix and denuded carrier granules. Thereafter, the unused developer mix and denuded carrier granules enter a region relatively free from magnetic forces and fall from developer means 76 in a downwardly direction into the lower region of developer housing 70. As the unused developer mix and denuded carrier granules descend, they pass through mixing baffle 92 which diverts the flow from the end toward the center of developer housing 70 to provide mixing in this direction.

When the latent image recorded on photoconductive surface 12 has passed development zone 90, the development action must be discontinued and the developer mix removed from contact with photoconductive surface 12 of drum 10 so that it will not effect subsequent images which are to be developed in different colors.

Cylindrical shroud 84 serves to control the fall of the unused developer mix and denuded carrier granules so that they mix with the toner particles rather than simply falling into the lower region of housing 70. Furthermore, shroud 84 isolates, from the developer mix, an interior cylindrical enclosure which has a cylindrical toner dispenser 94 disposed therein. Toner dispenser 94 contains a fresh supply of toner 96 which passes through aperture 86 in shroud 84 into the stream of developer mix 82. Adding toner particles at this location insures that it cannot be carried into development zone 90 without some degree of mixing with the carrier granules. Additional toner particles are added to the developer mix in order to replace the toner particles used in forming the powder images. This maintains the concentration of toner particles within the developer mix substantially constant so as to provide uniform image developability.

Developer housing 70 is pivoted about the center of cylindrical member 72 and is supported at the lower region of the exterior surface thereof by rollers 98 and 100. Rollers 98 and 100 are mounted in frame 68 and rotate about their respective axis to permit developer housing 70 to pivot substantially about the center of cylindrical member 72. When development unit 38 is inoperative, biasing means or spring 102 pivots developer housing 70 against stop 104. In this position, developer means 76 is in its inoperative position spaced from photoconductive surface 12. Operation begins when clutch gear 106 meshes with gear 108 which is attached to cylindrical member 72. This causes cylindrical member 72 to revolve clockwise, as indicated by arrow 110. As gear 108 and cylindrical member 72 start to rotate, a reaction torque is exerted against developer housing 70 due to the resistance to motion provided by developer mix 82 which fills developer housing 70. This reaction torque causes housing 70 to rotate clockwise against the force of spring 102 until a stop, shown as a wheel 112, is positioned against drum 10. This moves the developer mix in an upwardly direction to the development zone as heretofore described. When the complete electrostatic latent image recorded on photoconductive surface 12 of drum 10 has passed through development zone, development action is discontinued and the developer mix removed from contact therewith. This prevents the developer mix from effecting subsequent images which are to be developed by differently colored toner particles. To achieve the foregoing, the drive motor is disconnected from the gear 106 by de-energizing the clutch leaving gear 106 free to turn in either direction. Cylindrical member 72 then stops rotating and housing 70 is pivoted clockwise by spring 102 until it engages stop 104 in its operative position.

In the preferred embodiment thereof, developer means 76 includes a non-magnetic tubular member 114, preferably made from aluminum having an irregular or roughened exterior surface, Tubular member 114 is journaled for rotation by suitable means such as ball bearing mounts. A shaft 116 made, preferably, of steel, is mounted concentrically within tubular member 114 and serves as a fixed mounting for magnetic means 118. Magnetic means 118, preferably, comprises magnets made of barium ferrite in the form of annular rings and arranged with five poles on about a 284° arc about shaft 116.

Similarly, transport means 74 includes a non-magnetic tubular member 120, preferably made from aluminum having an irregular or roughened exterior surface. Tubular member 120 is journaled for rotation by suitable means such as ball bearing mounts. A shaft 122 made, preferably, of steel is concentrically mounted within tubular member 120 and functions as a fixed mounting for magnetic means 124. Magnetic means 124, preferably, includes magnet made of barium ferrite in the form of annular rings arranged with four poles on 180° arc about shaft 122. The detailed structural arrangement of cylindrical member 72 and buckets 78 will be described hereinafter with reference to FIG. 4.

While the transport means and developer means have been described as having a rotating cylinder and stationary magnets, one skilled in the art will recognize that the reverse may be true, i.e. the cylinder may be stationary with the magnets rotating.

Figure 4:
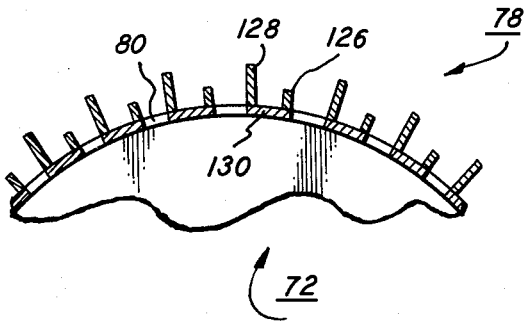
FIG. 4 is a fragmentary, sectional, elevational view depicting the buckets of the cylindrical member employed in the FIG. 3 developer unit.

Turning now to FIG. 4, there is shown a fragmentary section elevational view depicting cylindrical member 72 in greater detail. Cylindrical member 72 includes a plurality of buckets 78 disposed about and secured to the peripheral surface 130 thereof. The buckets are spaced from one another and extend in a lengthwise direction substantially parallel to the longitudinal axis of the cylindrical member. Each of the buckets has a pair of spaced walls 126 and 128 extending substantially radially outwardly from the peripheral surface 130 of cylindrical member 72. Wall 128 extends a greater radial distance than wall 126 from peripheral surface 130 of cylindrical member 72. Adjacent buckets 78 are separated from one another by longitudinally extending slots 80 in peripheral surface 130 of cylindrical member 72. Preferably, surface 130 has a thickness of about 0.060 inches. The height of wall 128 is preferably 0.250 inches and the height of wall 126 is preferably 0.100 inches. In a preferred embodiment thereof there are approximately 20 buckets 78 disposed equally about peripheral surface 130 of cylindrical member 72. In this configuration, the buckets act as a scoop preventing bridging of the toner particles across the walls thereof. A bridging action of this type would prevent the developer mix from filling the buckets and furnish none or little thereof to the respective transport and developer rolls. This would render development inadequate. Thus, it is highly desirable to furnish sufficient developer mix to the transport and developer rolls. The utilization of a bucket having a foreshortened wall prevents bridging as a force normal to the bridging surface is applied to the developer mix. The foregoing would not be the case if both the wall were substantially the same height. Thus, the utilization of buckets having one wall shorter than the other wall produces a normal force tending to prevent bridging between opposed walls of the buckets.

It is, therefore, evident that there has been provided in accordance with the present invention an apparatus for developing an electrostatic latent image that fully satisfies the objects, aims, and advantages hereinbefore set forth. While this invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An apparatus for rendering a latent image visible, including:

a housing member defining a chamber for storing a supply of particles therein;

means for depositing particles on the latent image;

a cylindrical member mounted rotatably in said housing member to advance the particles from the chamber therein to said depositing means, said cylindrical member having a plurality of spaced buckets secured to the peripheral surface thereof and extending lengthwise in a direction substantially parallel to the longitudinal axis of said cylindrical member, each of the buckets having a pair of spaced walls extending substantially radially outwardly from the peripheral surface of said cylindrical member with one of the pair of walls extending a greater radial distance than the other one of the pair of walls; and means for rotating said cylindrical member in a direction such that the one of the pair of walls extending a greater detail radial distance than the other one of the pair of walls trails the latter.

2. An apparatus as recited in claim 1, wherein the peripheral surface of said cylindrical member includes a plurality of longitudinally extending slots interposed between adjacent buckets.

3. An apparatus as recited in claim 2, wherein said depositing means includes:

rotary driven transport means mounted within the chamber of said housing member and positioned to receive the particles being moved by the buckets of said cylindrical member; and rotary driven developer means mounted within the chamber of said housing member closely proximate to said transport means to receive the particles therefrom, said developer means depositing particles on the latent image when in operative communication therewith.

4. An apparatus as recited in claim 3, further including means for resiliently urging said housing member to move from an operative position wherein said developer means is adjacent the latent image to an inoperative position wherein said developer means is spaced from the latent image, said rotating means driving said cylindrical member such that the reaction torque to the rotating moment applied to said cylindrical member moves said housing member disposing said developer means adjacent the latent image in operative communication therewith.

5. An apparatus as recited in claim 4, wherein:

said transport means includes a first tubular member of non-magnetic material and first magnetic means disposed within said first tubular member for creating a magnetic field in the path of the periphery of said first tubular member; and said developer means includes a second tubular member of non-magnetic material and second magnetic means disposed within said second tubular member for creating a magnetic field in the path of the periphery of said second tubular member.

6. An improved electrophotographic printing machine of the type having a photoconductive member, a corona generating device for charging the photoconductive member and an exposure mechanism for projecting a light image of an original document onto the charged photoconductive member to record an electrostatic latent image of the original document thereon, wherein the improvement includes:

a housing member defining a chamber for storing a supply of developer mix comprising carrier granules and toner particles;

means for depositing toner particles on the electrostatic latent image recorded on the photoconductive member;

a cylindrical member mounted rotatably in said housing member to advance the developer mix from the chamber to said depositing means, said cylindrical member having a plurality of spaced buckets secured to the peripheral surface thereof and extending lengthwise in a direction substantially parallel to the longitudinal axis of said cylindrical member, each of the buckets having a pair of spaced walls extending substantially radially outwardly from the peripheral surface of said cylindrical member with one of the pair of walls extending a greater radial distance than the other one of the pair of walls; and means for rotating said cylindrical member in a direction such that the one of the pair of walls extending a greater radial distance than the other one of the pair of walls trails the latter.

7. A printing machine as recited in claim 6, wherein the periphal surface said cylindrical member includes a plurality of longitudinally extending slots interposed between adjacent buckets.

8. A printing machine as recited in claim 7, wherein said depositing means includes;

rotary driven transport means mounted within the chamber of said housing member and positioned to receive the developer mix being moved by the buckets of said cylindrical member; and rotary driven developer means mounted within the chamber of said housing member closely proximate to said transport means to receive the developer mix therefrom, said developer means depositing toner particles on the electrostatic latent image when in operative communication with the photoconductive member.

9. A printing machine as recited in claim 8, further including means for resiliently urging said housing member to move from an operative position wherein said developer means is adjacent the electrostatic latent image recorded on the photoconductive member to an inoperative position wherein said developer means is spaced from the electrostatic latent image recorded on the photoconductive member said rotating means driving said cylindrical member such that the reaction torque to the rotating moment applied to said cylindrical member moves said housing member disposing said developer means adjacent the photoconductive member in operative communication with the electrostatic latent image recorded thereon.

10. A printing machine as recited in claim 9, wherein:

said transport means includes a first tubular member of non-magnetic material and first magnetic means disposed within said first tubular member for creating a magnetic field in the path of the periphery of said first tubular member; and said developer means includes a second tubular member of non-magnetic material and second magnetic means disposed within said second tubular member for creating a magnetic field in the path of the periphery of said second tubular member.

* * * * *